US008584280B2

(12) United States Patent
Shah

(10) Patent No.: US 8,584,280 B2
(45) Date of Patent: Nov. 19, 2013

(54) PEDIATRIC CRANIOFACIAL SURGICAL TABLE

(75) Inventor: Bharat Shah, Springfield, MO (US)

(73) Assignee: Mercy Medical Research Institute, Springfield, MO (US)

( * ) Notice: Subject to any disclaimer, the term of this patent is extended or adjusted under 35 U.S.C. 154(b) by 561 days.

(21) Appl. No.: 12/621,094

(22) Filed: Nov. 18, 2009

(65) Prior Publication Data

US 2010/0122414 A1 May 20, 2010

Related U.S. Application Data

(60) Provisional application No. 61/199,576, filed on Nov. 18, 2008.

(51) Int. Cl.
*A61G 7/00* (2006.01)
*A61G 7/02* (2006.01)

(52) U.S. Cl.
USPC ..... 5/603; 5/621; 5/622; 5/623; 5/630; 5/635; 5/637; 5/655

(58) Field of Classification Search
USPC ..... 5/603, 621, 622, 655, 623, 637, 630, 5/635
See application file for complete search history.

(56) References Cited

U.S. PATENT DOCUMENTS 4,757,811 A * 7/1988 Clark ..... 128/876
5,524,640 A * 6/1996 Lisak et al. ..... 5/655
5,577,503 A * 11/1996 Bonutti ..... 600/415
5,742,962 A * 4/1998 Yoshino et al. ..... 5/623
6,158,069 A * 12/2000 Boothe ..... 5/646
6,557,197 B1 * 5/2003 Graham ..... 5/630
6,934,988 B1 * 8/2005 Wetzler et al. ..... 5/621
6,966,087 B2 * 11/2005 Robinette ..... 5/625
7,716,764 B2 * 5/2010 Joe et al. ..... 5/655
7,861,341 B2 * 1/2011 Ayette et al. ..... 5/621
2005/0085722 A1 * 4/2005 Waterman ..... 600/427
2005/0210592 A1 * 9/2005 Littlehorn et al. ..... 5/655
2005/0278854 A1 * 12/2005 Taricani, Jr. ..... 5/655
2006/0123546 A1 * 6/2006 Horton et al. ..... 5/613
2007/0022537 A1 * 2/2007 Faustick ..... 5/655
2007/0039102 A1 * 2/2007 Thompson ..... 5/655.3

* cited by examiner

*Primary Examiner* — Robert G Santos
*Assistant Examiner* — Ifeolu Adeboyejo
(74) *Attorney, Agent, or Firm* — Lathrop & Gage LLP

(57) ABSTRACT

A pediatric surgical table configured to allow easy and quick positioning of an infant prior to craniofacial surgery which includes a head cradle with cheek supports, a chest ramp and a body support pad. The body support pad is provided with an abdominal trough to facilitate unhindered abdominal movement during breathing and a genital trough to allow placement of a urinary catheter. The chest ramp stabilizes the infant once positioned and decreases the risk of hyperextension of the neck. The cheek supports reduce the risk of ocular compression and a open chin rest area allows unrestricted placement of endotracheal tube. Straps are provided to secure the infant in place. The orientation of the chest ramp and head cradle allows for substantial adjustment of cervical extension and provides the surgeon with clear and unobstructed access to the frontal, parietal and occipital portion of the infant's skull.

21 Claims, 11 Drawing Sheets

PEDIATRIC CRANIOFACIAL SURGICAL TABLE

RELATED APPLICATION

This application claims benefit of U.S. Patent Application Ser. No. 61/199,576, filed Nov. 18, 2008, the disclosure of which is incorporated herein by reference.

BACKGROUND

Surgical tables are commonly utilized to support and retain patients in a specific desirable posture during a medical procedure. While some surgical tables are intended to allow the patient's extremities to be moved during a surgical procedure, most are designed to maintain the orientation of the patient's torso, head and extremities during the procedure. While numerous surgical tables have been designed and are commercially available, very few have ever been developed specifically for use with infants and very small children. Specifically, there are no known pediatric surgical tables configured to stabilize an infant in the prone position for skull surgery.

Currently, when infants and small children are positioned for craniofacial procedures, they are placed in the face down, or prone, position on a standard surgical table manufactured for use with adults. The infant is then manipulated into the desired position by surgical staff and rolled-up towels, sponges and other soft materials, generally referred to as "bolsters", are used to support the torso, extremities and head. The bolsters are arranged around the infant to position them in a preferred position for the specific surgical procedure. It is often necessary to tape, or otherwise secure, the bolsters to the surgical table and in some cases tape or straps are then used to secure the infant to the table.

Because of the complexity of many surgical procedures and the inherent risks associated with any surgical procedures on infants or small children, extraordinary care is necessary for the proper positioning, placement and retention of the head, neck, body and extremities. At present, surgical staff may take an hour or more to position an infant prior to craniofacial surgery. It is also common for the infant to shift during the procedure causing the bolsters to become dislodged. When this occurs, time consuming repositioning of the infant is required and the various risks associated with surgery are increased.

Because many surgeries require access to the frontal, parietal and occipital regions of an infant's head, traditional methods of strapping the infant's head in a fixed position with removable straps may be impractical. Moreover, placing an infant in the prone position creates additional risks. For example, inappropriate support of the infant's face while in the prone position increases the risk of ocular compression. Clear access is also needed to the mouth for placement of endotracheal tubes, ventilators and the like. Current methods make visual inspection of the mouth area difficult. Because drapings often are used to cover the infant's face during portions of the surgery, extended periods may occur where the mouth area cannot be visualized. Anesthesiologists generally prefer an unobstructed view of the patient's mouth. Inappropriate positioning also increases the risk of hyperextension of the neck and may diminish respiration motion as the abdomen is often compressed against the rigid surgical table.

Additional problems arise when conducting surgery on an infant strapped to a flat, rigid table. For example, urinary catheters may become trapped between the infant and the table causing injury to the infant and disrupting free flow through the tube. The line may kink or become dislodged. As the infant is typically covered in drapings, this may go unnoticed, which increases post-surgical recovery time. Incorrect positioning of the infant's arms during surgery may cause kinking of intravenous lines or otherwise cause injury or the formation of sores. A surgical table specifically configured for infant skull surgery is highly desired and needed. The invention described and claimed herein overcomes the identified deficiencies in the known apparatus and procedures related to pediatric craniofacial surgery performed on a standard operating table.

SUMMARY

A pediatric surgical table is provided which allows an infant to be comfortably and securely positioned during skull surgery. The table substantially decreases the normal set up time for positioning and securing the infant in an appropriate orientation for the surgery. The surgical table is appropriately sized for infants between the ages of 2 and 24 months, is light weight and easy to use. It is configured for placement on a standard sized operating table commonly found in surgical suites around the world. The inventive table is provided with securing straps or similar mechanisms which allow it to be securely fastened to an existing surgical table. The infant table includes a front or head portion, a ramp, optional abdominal and genital troughs, arm supports and a foot or end portion. It may also include a removable cradle for the additional support, positioning and retention of the infant's head during surgery.

For the purpose of clarity, the infant table is described in descending order from the head end to the foot end. The head end is the thickest part of the table and includes areas for securing the head cradle and arm supports. During a surgical procedure, the infant is placed in the prone position, face down in the head cradle with the top of the skull near the forward edge of the table. The head cradle is substantially U-shaped with a plurality of cut out portions and support pads. When the infant's head is placed in the cradle, a pair of spaced apart cheek support pads are oriented to receive and gently cradle the cheeks of the infant thereby reducing the risk of ocular compression. A chin rest positioned between the cheek supports is generally open and facilitates access to the mouth for positioning of endotracheal tubes and to allow safe visual monitoring of general anesthesia. The spaced-apart cheek supports can be moved laterally which allows the infant's head to be positioned with either a greater or lesser degree of neck flexion thereby allowing the surgeon to control the degree of cervical extension. In the preferred embodiment the entire head support mechanism is removable from the surgical table. This allows the surgeon to size the head support to the infant prior to placing them on the surgical table. It also facilitates greater flexibility in positioning of the cheek supports, chin rest and overall orientation of the head rest respective to the surgical table.

A pair of adjustable arm rests are also provided which are removably fastened to the forward or front end of the table. The adjustable arm rests are provided with hook and loop fasteners or similar fastening devices which allow them to be positioned and secured to the head cradle in a generally forward projecting orientation. When the infant is placed in the prone position, the arms are rotated forward in the flying man position with one arm on each of the rests. The rests are padded to reduce nerve compression and are provided with padded or rubberized retaining straps to secure the arms in a safe position during the procedure and to prevent inadvertent movement under surgical drapes.

Adjacent to the head rest portion of the table is a chest ramp configured to cradle the thorax which stabilizes the infant in position during surgery and facilitates appropriate ventilation (respiration) during the procedure. During many craniofacial procedures, the surgeon needs access to the back, crown and front of the skull. Once the surgery begins it is undesirable to move the infant's neck and head, therefore an orientation is needed which provides access to each of the stated regions of the skull. Currently, the infant's chest is elevated on bolsters and the head is tilted rearward to provide the desired access. The chest ramp of the inventive device has a predefined incline of approximately 30° which has been determined to best support the torso while diminishing the risk of hyperextension of the neck. The chest ramp may be made of a foam or other compressive materials such as rubber, polyurethane foam, open cell foam, polystyrene or other compressible material. It is preferable that the chest ramp is manufactured of a softer and more resilient material than the surrounding operating table surface area to decrease the likelihood of compression and injury to the infant during normal respiration.

Between the chest ramp and the foot portion of the table is an abdominal cut out or trough which facilitates unhindered abdominal movement during breathing. The abdominal cut out or trough may be manufacturing of a very soft and pliable material easily compressible during the normal respiration of the infant. Medially aligned within the abdominal cut out is a genital trough which reduces risk of pressure injury to the genitals and allows the positioning and placement of a urinary catheter. The chest ramp, abdominal cut out and genital trough and surrounding areas form a body support pad which may be removable from the surgical table.

A seat strap is provided to be fastened over the infant to prevent sliding or downward ramping in a rearward direction during the surgery. It is preferable the strap be provided with hook and loop fasteners mateable to similar fasteners positioned along the sides of the table so that the seat strap can be infinitely positioned along the length of the table.

The surgical table can be manufactured with a rigid frame member such as a sheet of rigid plastic fixed in the base. In the preferred apparatus, the entire table and the body support pad and head cradle are all manufactured from compressible foam or similar compressible materials. Because the infants intended for use with this table are typically 2 to 24 months old, their weight is not sufficient to substantially deform the table even in the absence of a rigid frame or skeleton. The entire table has a covering such as vinyl, water resistant canvas or similar material. Preferably, the covering material is removable and is water resistant and easy to clean and decontaminate between uses.

According to one aspect of the invention, the surgical table may also be provided with one or more inflatable or deflatable portions which allow the physician to further support the infant during surgery. The inclusion of inflatable and deflatable areas of the device reduce or eliminate undue pressure, friction sores, or undesirable compression in the chest, abdomen and genital areas. Such inflatable and deflatable regions also reduce the likelihood of having to reposition the infant during surgery and can enhance the stability of the infant during the procedure.

The table may also include recessed areas for the placement of heating pads, heated gel packs or similar materials utilized to control the ambient temperature of the infant during surgery. The surgical table does not include any metal components and does not need to be grounded during surgical procedures.

Another option available on the device is one or more built in storage drawers or trays positioned about the periphery of the table for placement and storage of medical equipment. A foot extension slide may also be provided at the foot portion of the table for the placement of items during the procedure.

It should be understood that the pediatric craniofacial surgical table can be utilized for other types of infant surgery. While the invention has been illustrated and described in detail in the drawings and the foregoing description, the same is to be considered illustrative and not restrictive of the character. It is to be understood that changes, modifications and equivalents that come within the scope and spirit of the invention as defined by the following claims are also desired to be protected.

BRIEF DESCRIPTION OF THE DRAWINGS

FIG. 7 is a partial view showing the head cradle of one embodiment of the invention.

FIG. 9 is a partial view of the body support pad insert of one embodiment of the invention.

DETAILED DESCRIPTION OF THE PREFERRED EMBODIMENTS

Figure 1:
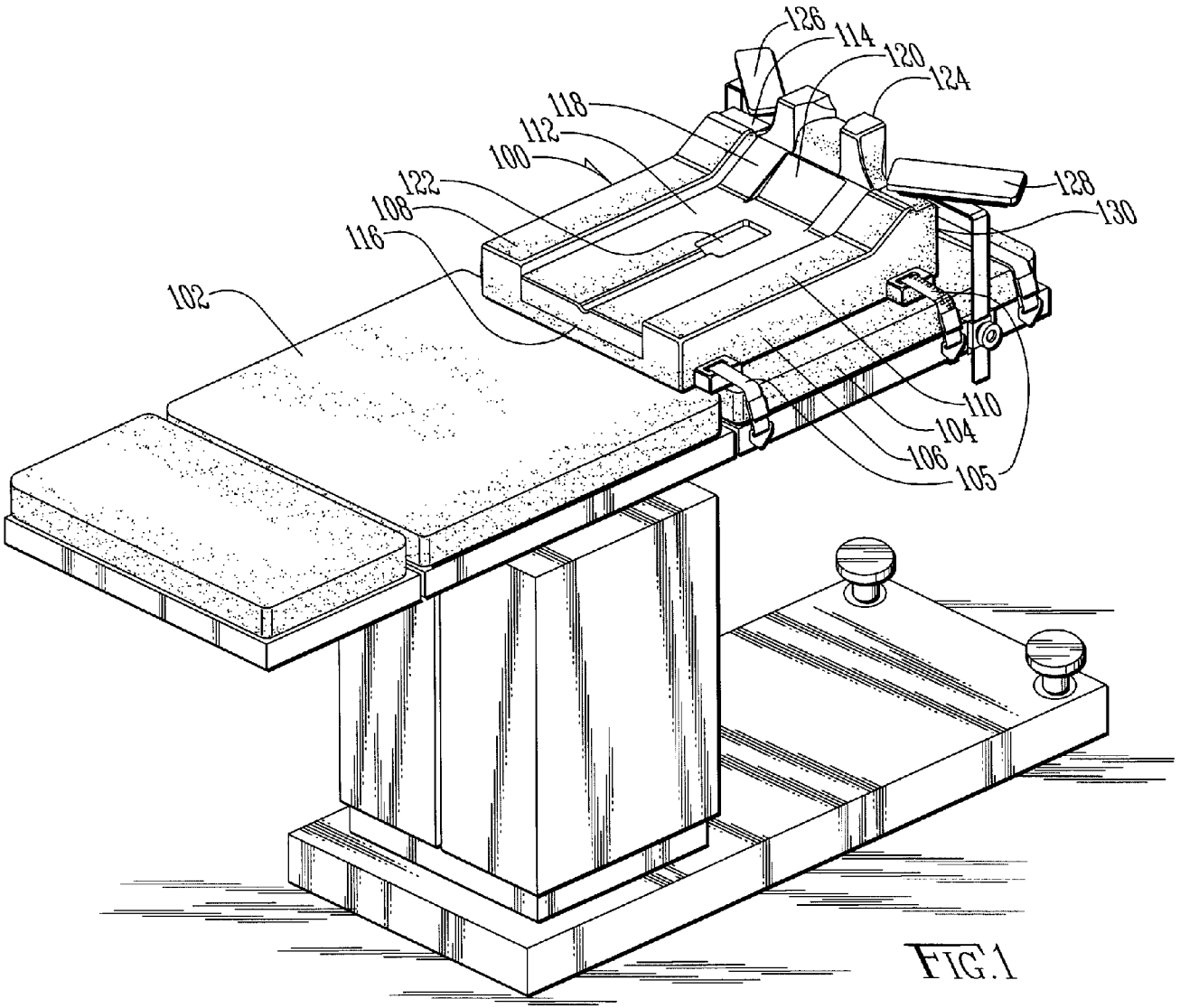
FIG. 1 is a perspective view of an embodiment of the pediatric surgical table configured for craniofacial surgery.
Figure 2:
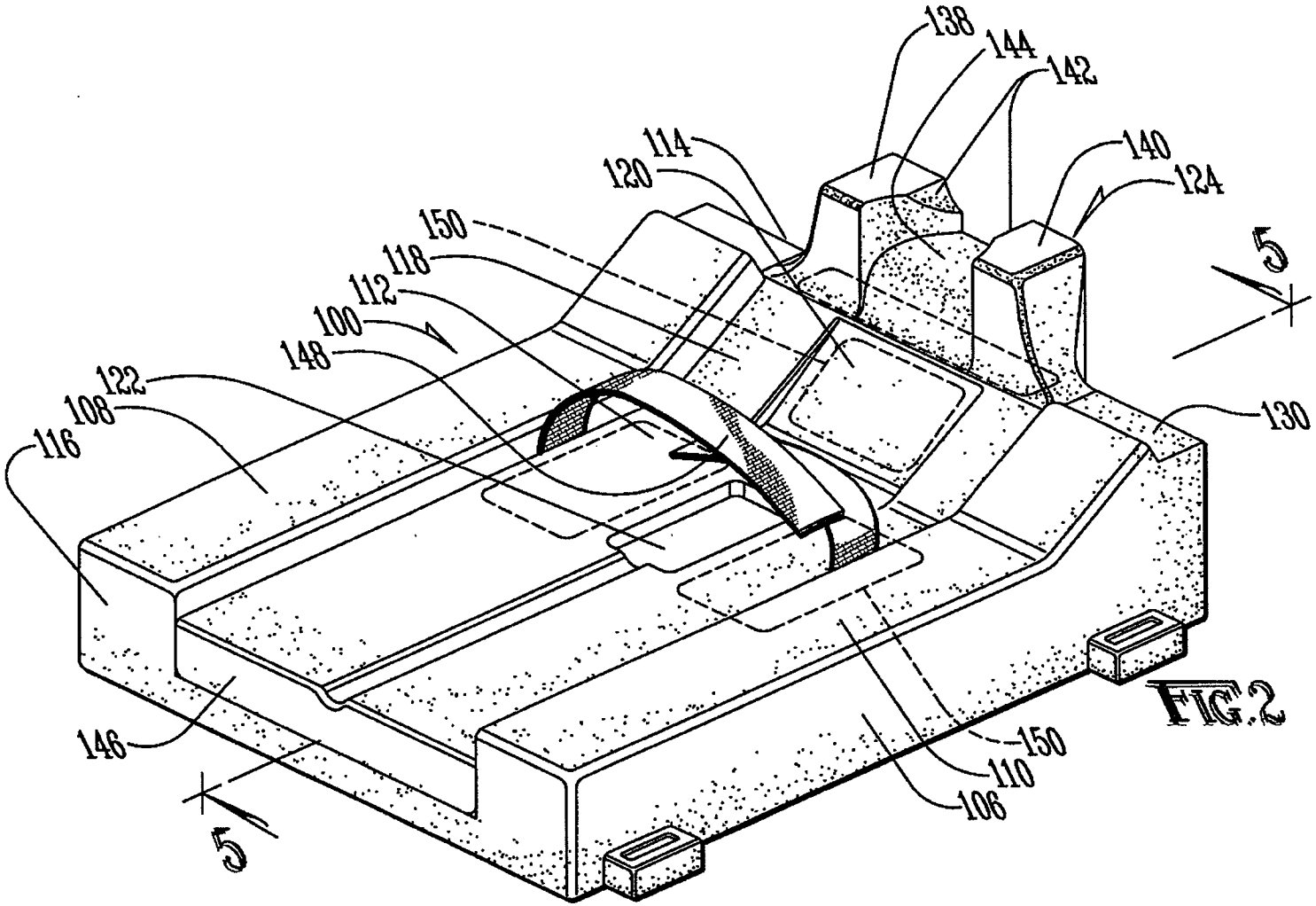
FIG. 2 is a perspective view of an embodiment of the pediatric surgical table.
Figure 3:
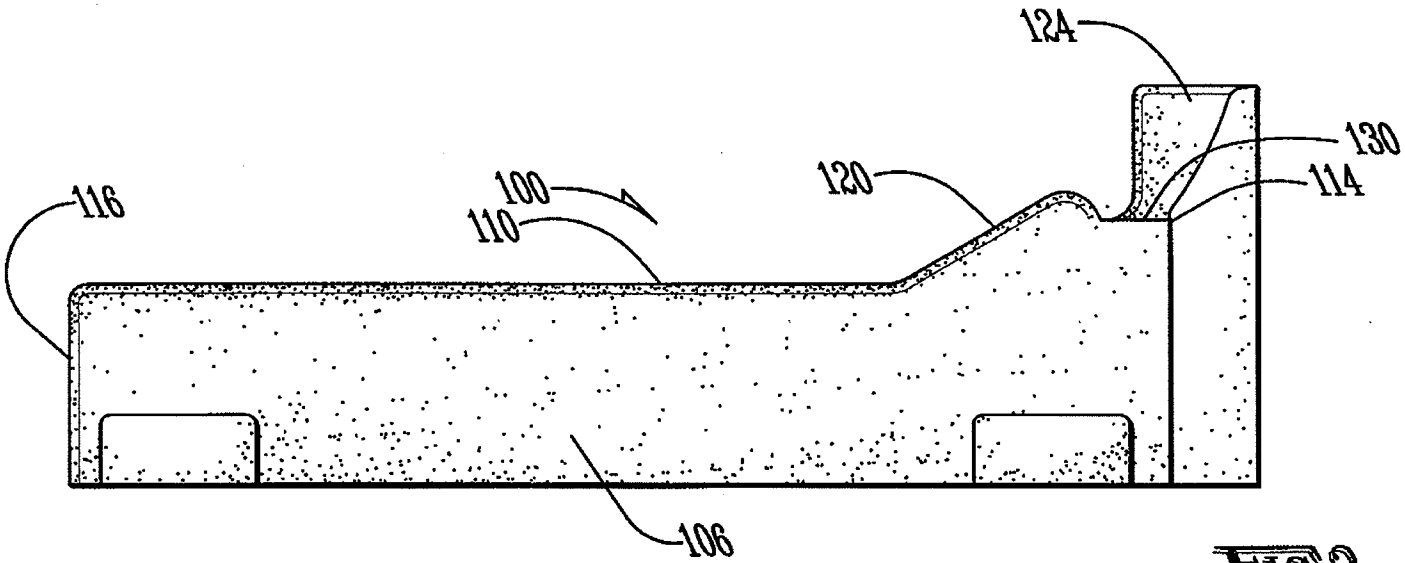
FIG. 3 is a side plan view of an embodiment of the pediatric surgical table.
Figure 4:
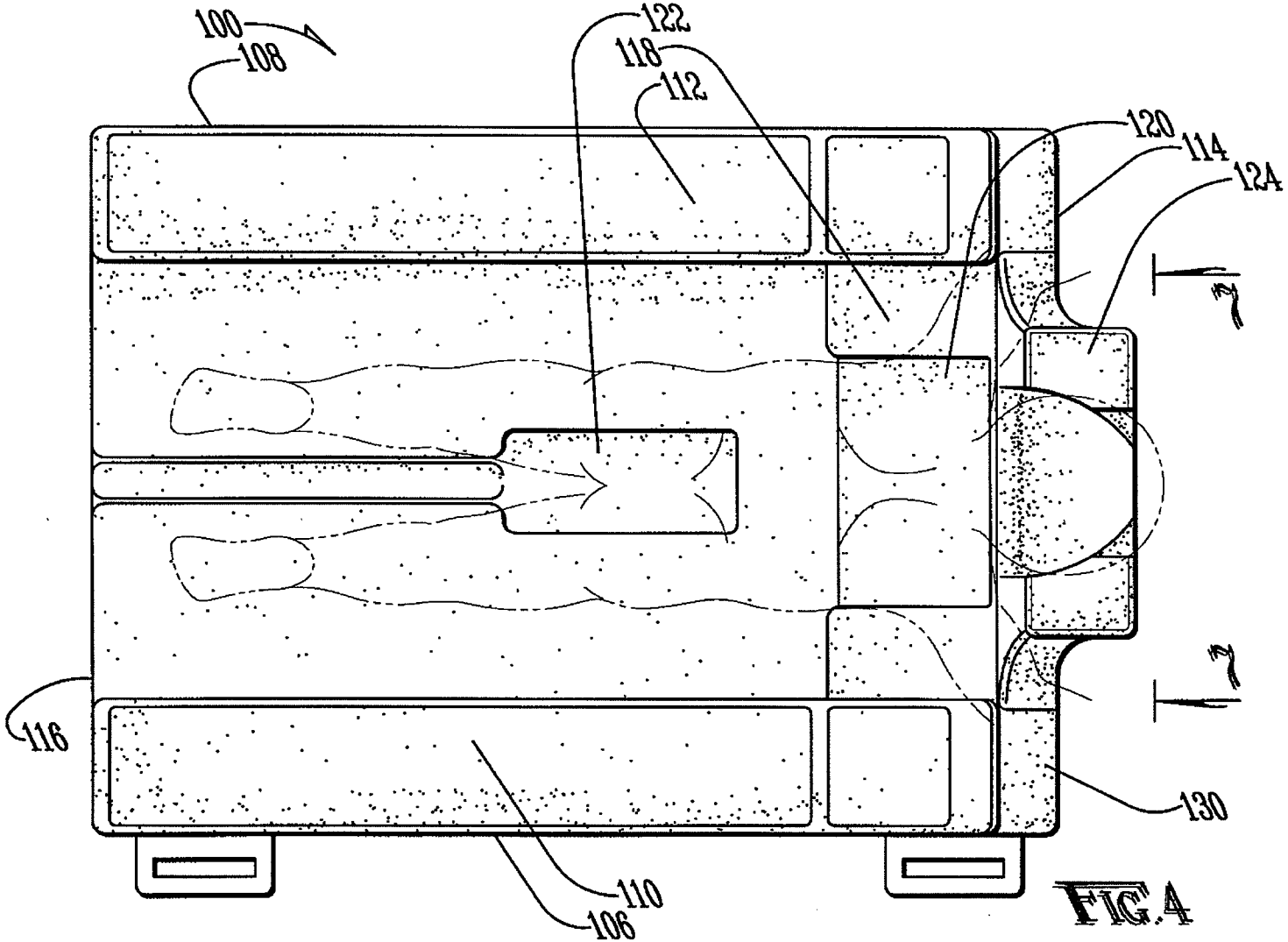
FIG. 4 is a top view of an embodiment of the pediatric surgical table with a child placed in position for skull surgery.

Now referring generally to the drawings, a pediatric surgical table is shown which allows an infant to be comfortably and securely positioned during skull surgery. Prior to the instant invention, infant craniofacial surgery required the placement of numerous bolsters to appropriately position the infant on a standard operating table. As shown in FIG. 1, the infant surgery table 100 substantially decreases the normal set up time for positioning and the securing the infant in an appropriate orientation for the surgery. As best shown in FIGS. 2 through 4, the surgery table 100 is appropriately sized for infants between the ages of 2 and 24 months. It is generally manufactured of light weight and readily available materials and is easy to use. The specific configuration of the surgery table 100 facilitates easy, accurate and repeatable placement of an infant for craniofacial surgery. It is intended for use with standard sized operating table 102 commonly found in surgical suites around the world. The inventive table 100 is provided with at least one securing strap 105 or similar mechanisms which allow it to be securely fastened to the existing operating table 102 as shown. The infant table 100 is substantially rectangular and includes a base 106, opposed sides 108, 110, and a top surface 112. An end wall 147 may also be provided, extending vertically from the head end of the base 106. The table 100 generally includes a front or head portion 114 and spaced apart foot or end portion 116. Between the head portion 114 and foot portion 116 are, in order, a chest ramp 118, an abdominal trough 120 and a genital trough 122. Further, the infant table has a removable head cradle 124 for the additional support, positioning and retention of the infant's head during surgery and arm supports 126, 128 for supporting and protecting the infant's arms. The removable head cradle may be provided with an optional head strap 149 for securing the infant's head in the head cradle.

Figure 5:
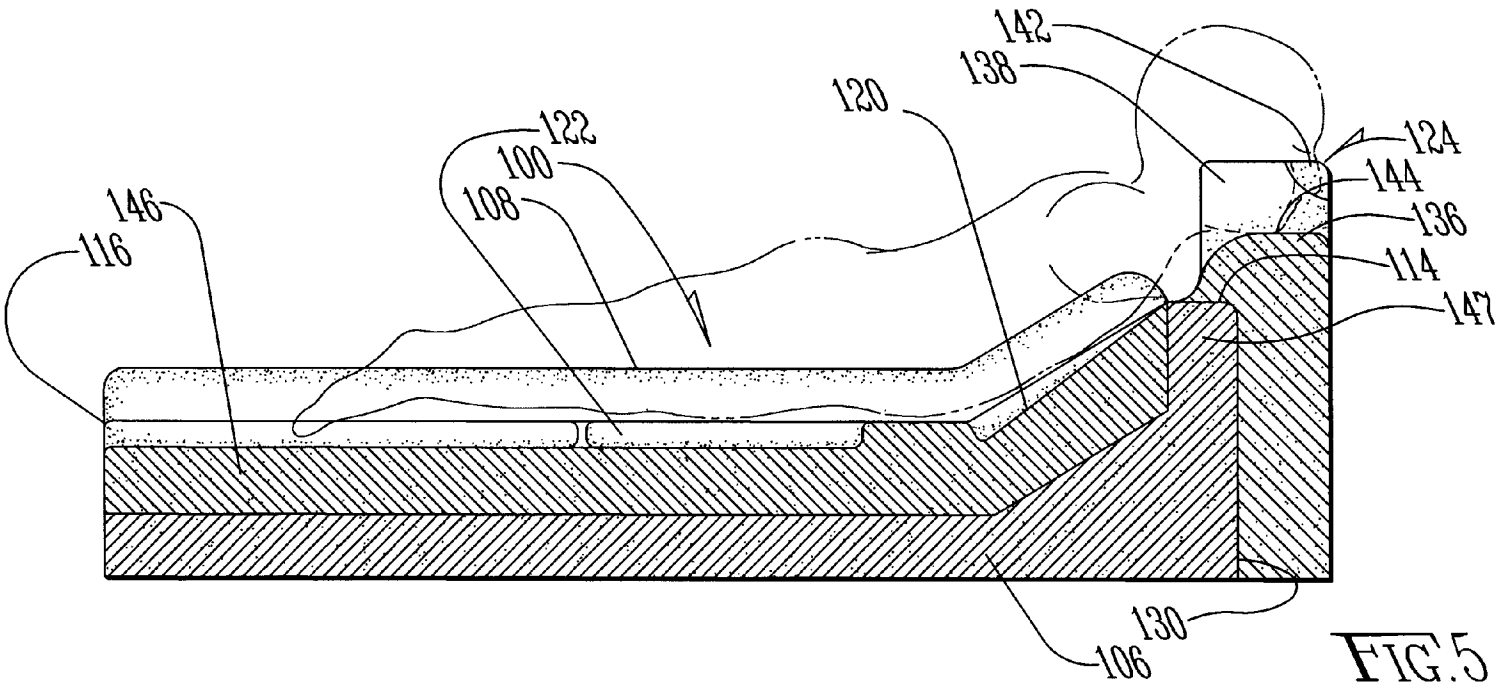
FIG. 5 is a side cross-sectional view of an embodiment of the pediatric surgical table with a child placed in position for skull surgery.
Figure 6:
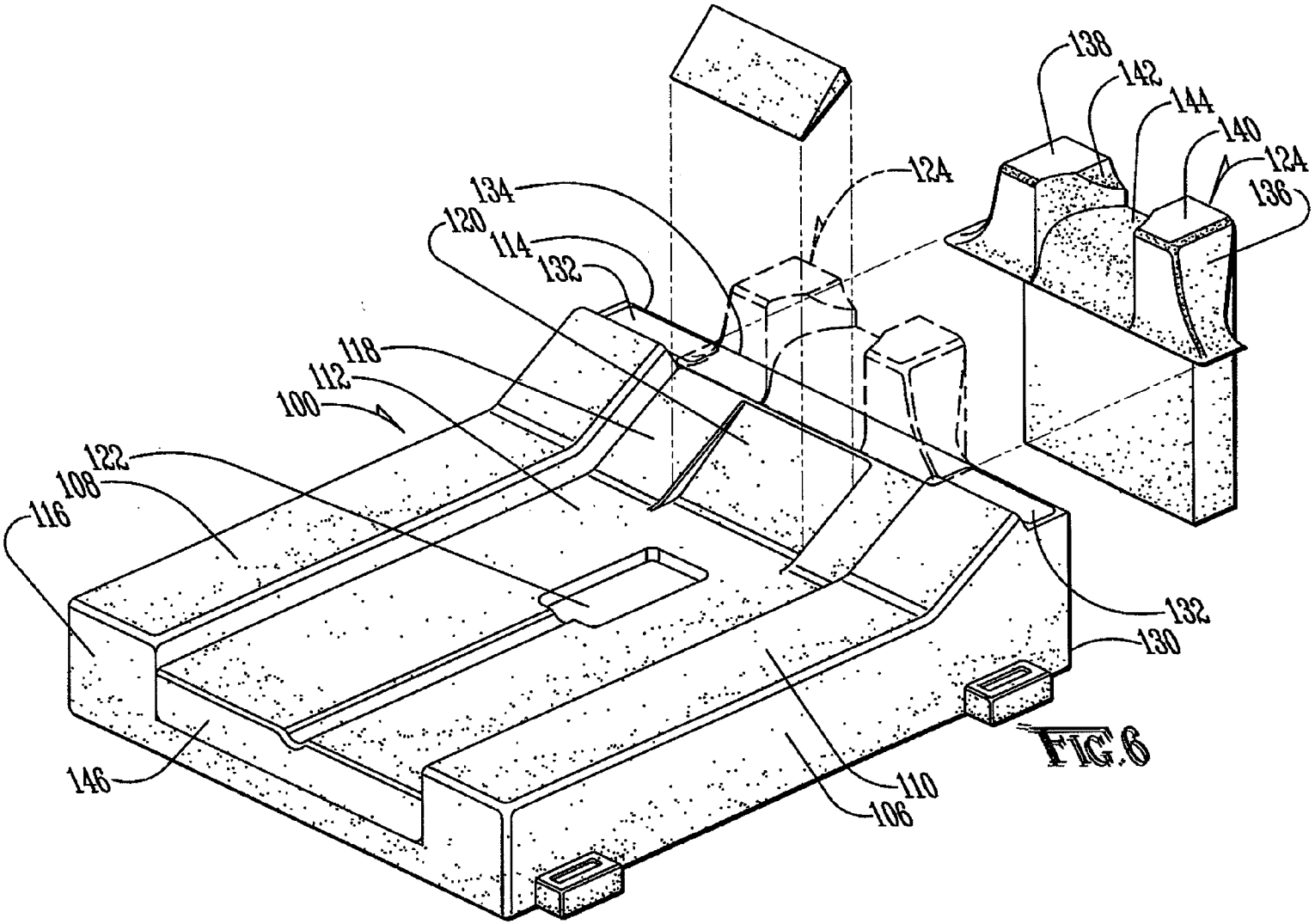
FIG. 6 is an exploded view of an embodiment of the pediatric surgical table.
Figure 1:
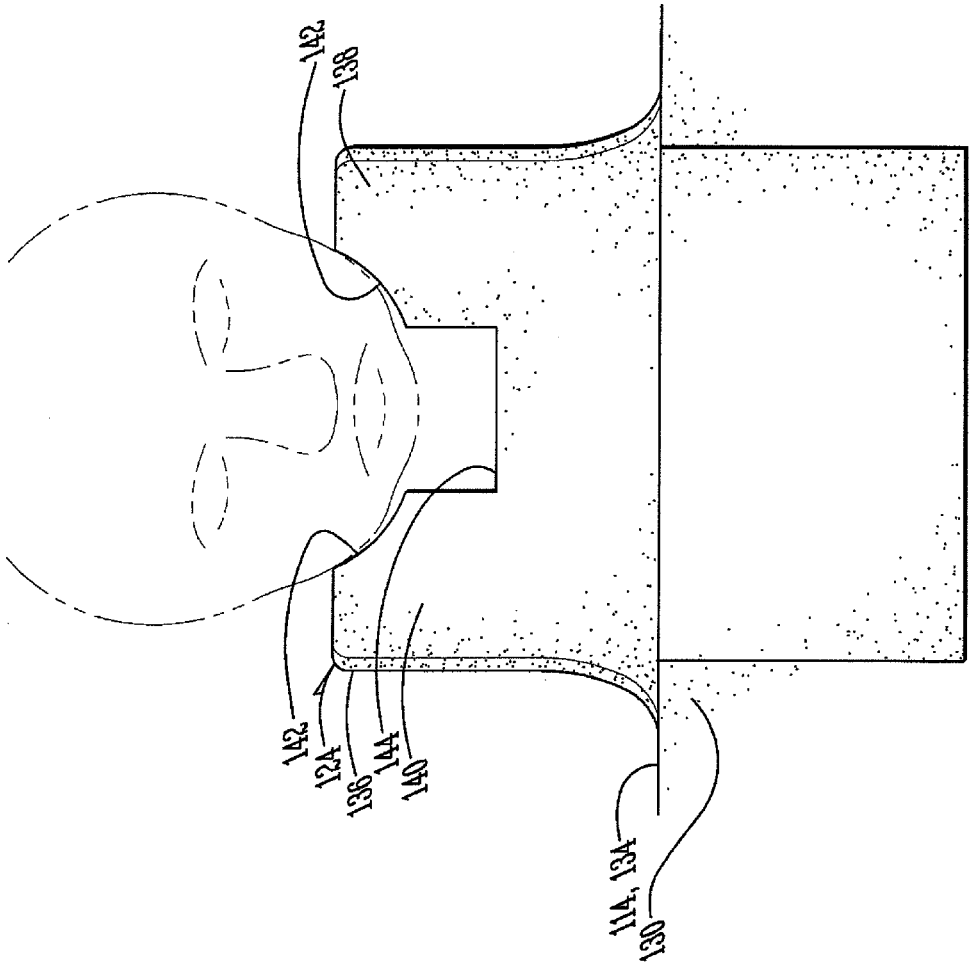

For the purpose of clarity, the infant table is described in descending order from the head end 114 to the foot end 116. As shown in FIGS. 5 and 6, the head end 114 has a substantially flat accessory fastening area 130 for securing the head cradle 124 and arm supports 126, 128. The accessory fastening area 130 is provided with strips of hook and loop fasteners 132 or other suitable fastening devices. It is preferred that the head cradle 124 and arm supports 126, 128 are provided with mateable fastening devices so that they can be removably secured to the accessory fastening area 130.

Figure 8:
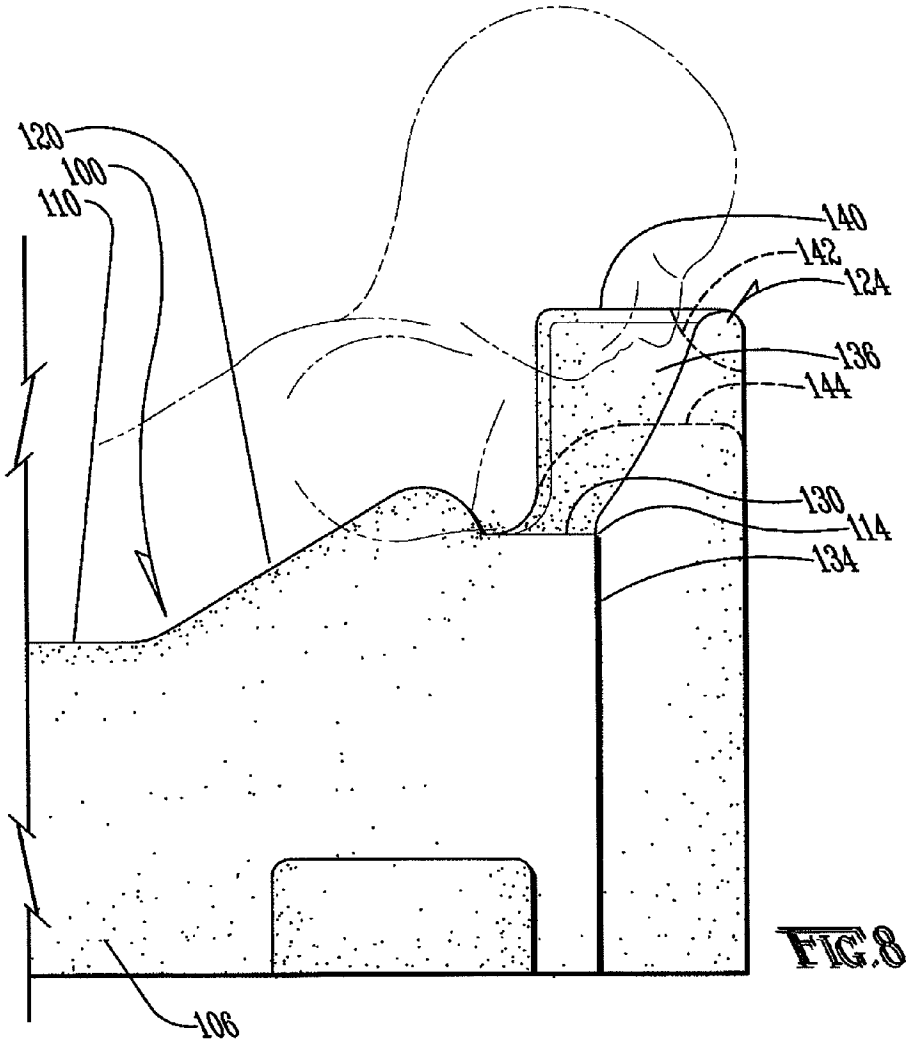
FIG. 8 is a partial plan view of the head cradle of the embodiment depicted in FIG. 7.
Figure 8:
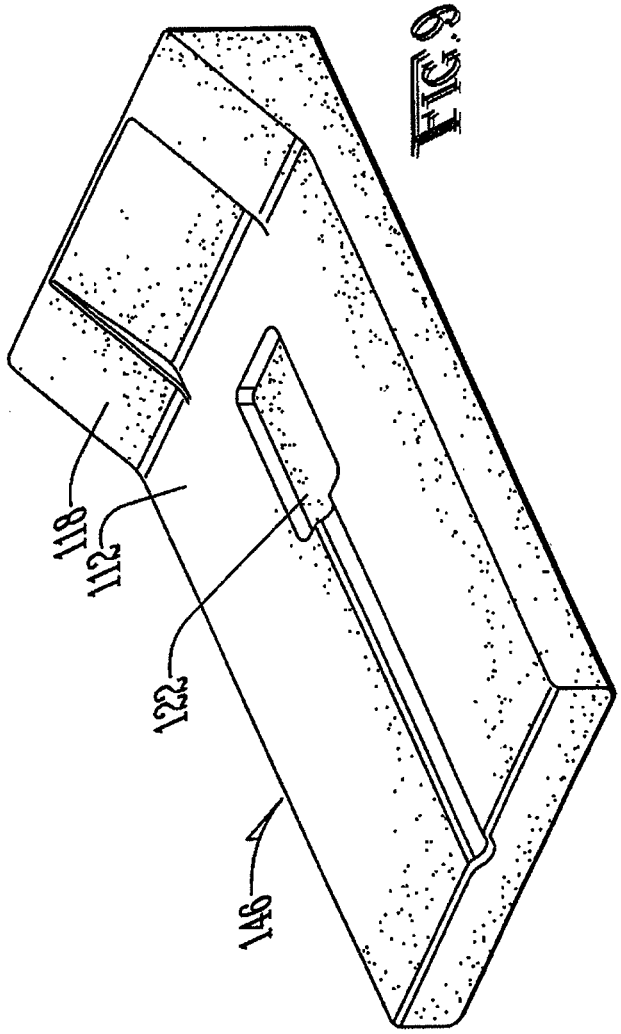

During a craniofacial surgical procedure, the infant is placed in the prone position, face down in the head cradle 124 with the top of the skull near the forward edge 134 of the table 100. As shown in FIGS. 7 and 8, the head cradle 124 is substantially U-shaped, having a pedestal 136 and two spaced apart support members 138, 140. Each support member 138, 140 is provided with a intermedially oriented beveled portions which form cheek rests 142. The cheek rests 142 receive and gently cradle the cheeks of the infant thereby reducing the risk of ocular compression. A chin rest 144 positioned between the cheek rests 142 is generally open and facilitates access to the mouth for positioning of endotracheal tubes and to allow safe visual monitoring of general anesthesia. The spaced-apart head cradle support members 138, 140 may be formed separately from the pedestal 136 so that they can be adjusted laterally to accommodate different sized infant heads. This also allows the infant's head to be positioned with either a greater or lesser degree of neck flexion thereby allowing the surgeon to control the degree of cervical extension. In the preferred embodiment the entire head cradle 124 is removable from the surgical table 100. This allows the surgeon to size the head cradle 124 to the infant prior to placing them on the surgical table 100. It also facilitates greater flexibility in positioning of the cheek supports 142, chin rest 144 and overall orientation of the head cradle 124 respective to the surgical table 100.

Figure 10:
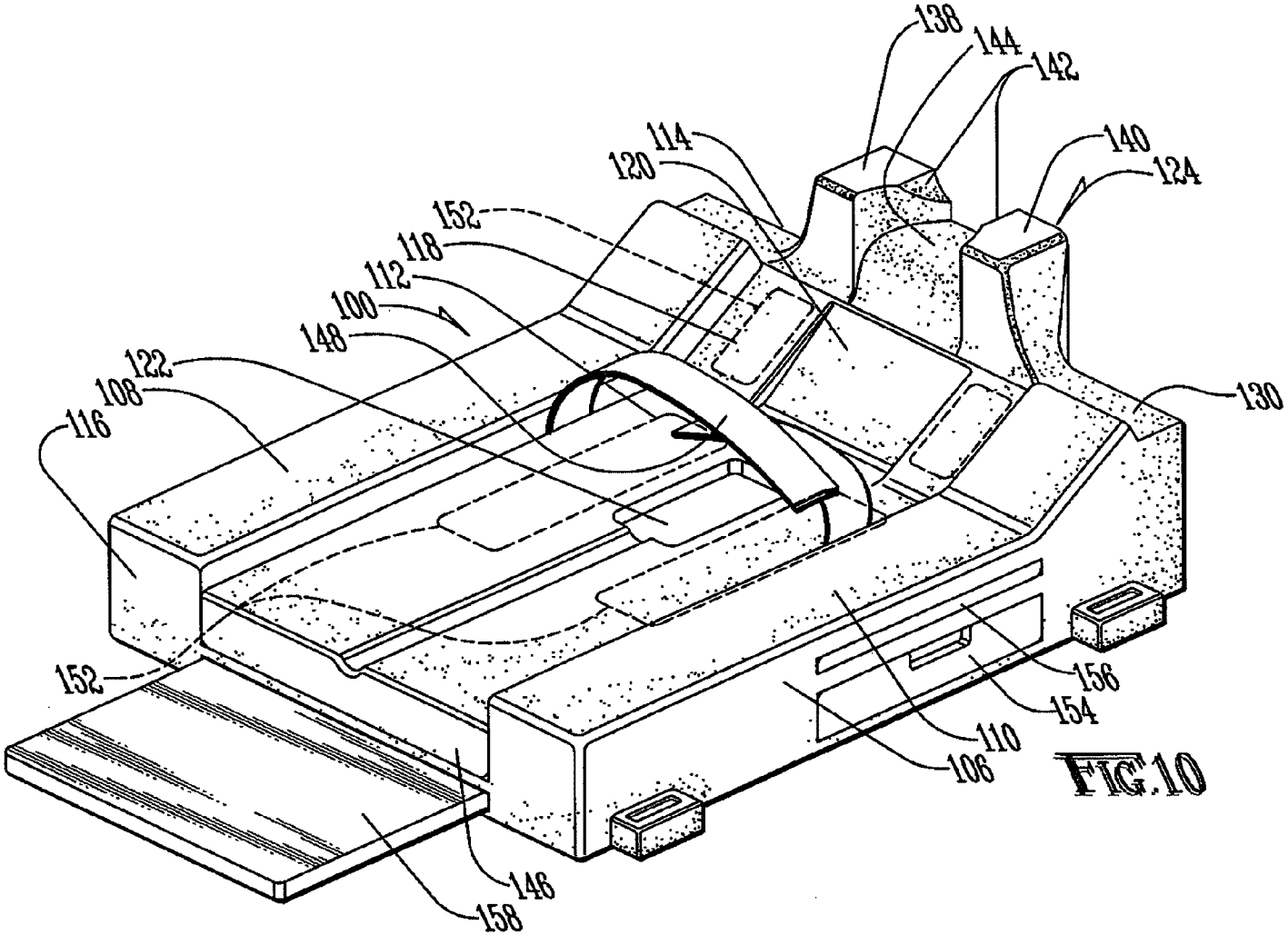
FIG. 10 is another perspective view of another embodiment of the invention with accessories shown.
Figure 11:
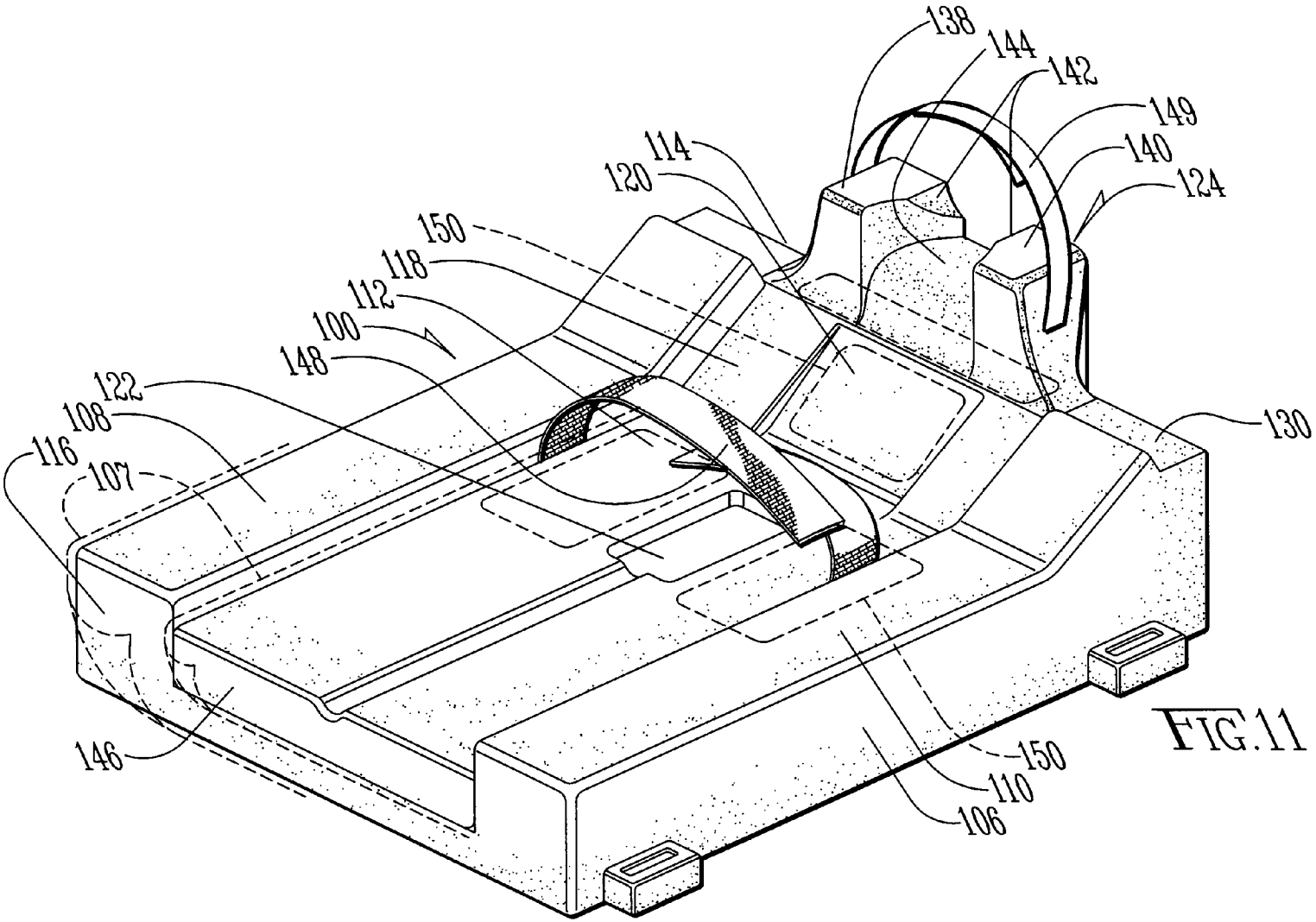
FIG. 11 is perspective view of an alternative embodiment of the pediatric surgical table.

A pair of adjustable arm supports 126, 128 are also provided which are removably fastened to the accessory fastening area 130 as shown in FIG. 1. The adjustable arm supports 126, 128 are provided with hook and loop fasteners or similar fastening devices which allow them to be positioned adjacent the head cradle 124 in a generally forward projecting orientation. When the infant is placed in the prone position, the arms are rotated forward in the flying man position with one arm on each of the arm supports 126, 128. The arm supports 126, 128 are padded to reduce nerve compression and are provided with padded or rubberized retaining straps to secure the arms in a safe position during the procedure and to prevent inadvertent movement under surgical drapes Adjacent to the head portion 114 of the table 100 is a chest ramp 118 configured to cradle the thorax which stabilizes the infant in position during surgery and facilitates appropriate ventilation (respiration) during the procedure. During many craniofacial procedures, the surgeon needs access to the back, crown and front of the skull. Once the surgery begins it is undesirable to move the infant's neck and head, therefore and orientation is needed that provides access to each of the stated regions of the skull. As shown in FIGS. 9 and 10, the chest ramp 118 has a predefined incline of approximately 30° which has been determined to best support the torso while diminishing the risk of hyperextension of the neck. It is understood that the angle of incline of the chest ramp 118 can be changed without departing from the scope of the invention. The chest ramp 118 may be made of a foam or other compressive materials such as rubber, polyurethane foam, open cell foam, polystyrene or other compressible material. In one embodiment, the chest ramp 118 is concave to further retain the infant in position. It is preferable that the chest ramp 118 is manufactured of a softer and more resilient material than the surrounding operating table surface area to decrease the likelihood of compression and injury to the infant during normal respiration.

Between the chest ramp 118 and the foot portion 116 of the table 100 is an abdominal cut out or trough 120 which facilitates unhindered abdominal movement during breathing. The abdominal trough 120 may be manufactured of a very soft and pliable material easily compressible during the normal respiration of the infant. Medially aligned within the abdominal cut 120 out is a genital trough 122 which reduces risk of pressure injury to the genitals and allows the positioning and placement of a urinary catheter. The chest ramp 118, abdominal cut out 120 and genital trough 122 form a body support pad 146 which may be removable from the surgical table 100 as shown in FIG. 9.

At least one seat strap 148 is provided to be fastened over the infant to prevent sliding or downward ramping in a rearward direction during the surgery. It is preferable the strap 148 be provided with hook and loop fasteners mateable to similar fasteners positioned along the sides 108, 110 of the table 100 so that the seat strap can be infinitely positioned along the length of the table 100.

The surgical table 100 can be manufactured with a rigid frame member in the base 106. One such example is a sheet of rigid plastic (not shown) fixed in the base. In embodiments, the entire table 100 including the body support pad 146 and head cradle 124 are all manufactured from compressible foam or similar compressible materials. Because the infants intended for use with this table are typically 2 to 24 months old, their weight is not sufficient to substantially deform the table 100 even in the absence of a rigid frame or skeleton. The entire table has a covering such as vinyl, water resistant canvas or similar material. In embodiments, the covering material 107 is removable and is water resistant and easy to clean and decontaminate between uses.

According to one aspect of the invention, the surgical table 100 may also be provided with one or more inflatable or deflatable portions 150 which allow the physician to further support the infant during surgery. The inclusion of inflatable and deflatable portions 150 of the table 100 reduce or eliminate undue pressure, friction sores, or undesirable compression in the chest, abdomen and genital areas. Such inflatable and deflatable portions 150 also reduce the likelihood of having to reposition the infant during surgery and can enhance the stability of the infant during the procedure.

As shown in FIG. 10, the table 100 may also include recessed areas 152 for the placement of heating pads, heated gel packs or similar materials utilized to control the ambient temperature of the infant during surgery. The surgical table 100 does not include any metal components and does not need to be grounded during surgical procedures.

Another option available on the device is one or more built in storage drawers 154 or trays 156 positioned in the sides 108, 110 of the table 100 for placement and storage of medical equipment. A foot extension slide 158 may also be provided at the foot portion 116 of the table 100 for the placement of items during the procedure.

It should be understood that the pediatric craniofacial surgical table can be utilized for other types of infant surgery. While the invention has been illustrated and described in detail in the drawings and the foregoing description, the same is to be considered illustrative and not restrictive of the character. It is to be understood that changes, modifications and equivalents that come within the scope and spirit of the invention as defined by the following claims are also desired to be protected.

What is claimed is:

1. A surgical table for supporting and securing an infant in a prone position during a surgical procedure on an operating room table, comprising:

a base for fastening to an operating room table comprising a bottom panel, two side walls extending vertically from two opposing edges of the bottom panel, and an end wall extending vertically from a third edge of the bottom panel at a head end thereof and connecting to the side walls at each end thereof;

a head cradle positioned adjacent to the head end of the base and having a chin rest and spaced apart cheek supports, said cheek support disposed on opposite sides of the chin rest and extending upwardly above said chin rest;

a body support pad incorporating a chest ramp adjacent to a head end of the body support pad;

a pair of adjustable arm supports removably attached to the end wall of the base capable of receiving and retaining the arms of an infant; and a strap to secure an infant to the body support pad;

wherein the body support pad is positioned on the top surface of the base with the chest ramp disposed adjacent to the end wall of the base.

2. The surgical table of claim 1 wherein the body support pad includes an abdominal trough.

3. The surgical table of claim 1 wherein the body support pad includes a genital trough.

4. The surgical table of claim 1 wherein the body support pad is formed of a material which is more compressible than the base.

5. The surgical table of claim 1 wherein the body support pad is removable from the base.

6. The surgical table of claim 1 further comprising a removable covering.

7. The surgical table of claim 1 further comprising a plurality of recessed areas for the receipt and retention of gel packs or heating pads for warming an infant.

8. The surgical table of claim 1 further comprising a plurality of inflatable portions.

9. The surgical table of claim 1 wherein the base, head cradle or body support pad further comprises at least one cavity for a storage drawer.

10. The surgical table of claim 1 wherein the head cradle is formed from foam.

11. The surgical table of claim 1 wherein the head cradle is removably secured to the base.

12. The surgical table of claim 11 wherein a plurality of head cradles of varying sizes are provided for fitting to the head of an infant.

13. The surgical table of claim 1 further comprising a plurality of fastening straps to secure the surgical table to the top surface of an operating table.

14. A method for using the surgical table of claim 1 comprising the steps of:

securing the surgical table to an operating room table;

placing an infant in a prone position on the surgical table;

positioning the head of an infant in the head cradle;

disposing the adjustable arm supports to support the arms of an infant in a desired position; and securing an infant to the surgical table with the strap.

15. The method of claim 14 wherein the body support pad includes a chest ramp disposed adjacent to the end wall of the base.

16. The method of claim 15 wherein the body support pad includes an abdominal trough.

17. The method of claim 15 wherein the body support pad includes a genital trough.

18. The method of claim 14 wherein the step of positioning the head of an infant in the head cradle comprises the steps of:

selecting a head cradle sized to support an infant's head; and removably attaching the selected head cradle to the base.

19. The method of claim 15 wherein the step of placing an infant in a prone position on the surgical table further comprises the steps of:

positioning the chest of an infant on the chest ramp of the body support pad with the upper thorax of an infant positioned adjacent to the upper end of the chest ramp;

securing the arms of an infant to the arm rests; and positioning the head of an infant in the head cradle with the cheeks of an infant in contact with and supported by the cheek supports and the chin of an infant located between the cheek supports.

20. The method of claim 14 wherein the body support pad further comprises cavities for receiving heating pads, gel packs for warming the infant, or drawers.

21. The method of claim 14 wherein the body support pad further comprises inflatable and deflatable portions.

* * * * *